US007063511B2

(12) United States Patent
Urbank et al.

(10) Patent No.: US 7,063,511 B2
(45) Date of Patent: Jun. 20, 2006

(54) INTEGRATED CONTROL VALVE FOR A VARIABLE CAPACITY COMPRESSOR

(75) Inventors: Thomas Martin Urbank, Lockport, NY (US); Karma Vir Sangwan, East Amherst, NY (US); Ernesto Jose Gutierrez, Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 504 days.

(21) Appl. No.: 10/628,633

(22) Filed: Jul. 28, 2003

(65) Prior Publication Data

US 2005/0025632 A1 Feb. 3, 2005

(51) Int. Cl.
*F04B 1/26* (2006.01)

(52) U.S. Cl. ..... 417/222.2

(58) Field of Classification Search ..... 417/222.2; 62/228.3, 228.5

See application file for complete search history.

(56) References Cited

U.S. PATENT DOCUMENTS 6,126,405 A 10/2000 Kawaguchi et al. ..... 417/222.2
6,361,281 B1 3/2002 Wurth et al.
6,381,545 B1 4/2002 Goubeaux et al.
6,439,858 B1 8/2002 Kume et al. ..... 417/222.2
6,568,920 B1 5/2003 Yttri et al.
6,575,708 B1 6/2003 DeWispelaere
6,622,500 B1 9/2003 Archibald et al.
6,732,541 B1 * 5/2004 Urbank et al. ..... 417/222.2
6,799,952 B1 * 10/2004 Urbank et al. ..... 417/222.2

* cited by examiner

*Primary Examiner*—Michael Koczo, Jr.
(74) *Attorney, Agent, or Firm*—Patrick M. Griffin

(57) ABSTRACT

An integrated capacity control valve for a variable capacity refrigerant compressor includes an integral pressure sensor that is continuously coupled to a discharge port of the valve for measuring the refrigerant discharge pressure. A plunger of the control valve is disposed within a passage coupling the compressor crankcase to the discharge port, and is positioned by pneumatic and electric control elements to regulate the refrigerant suction pressure. The plunger has intersecting axial and lateral bores that define a continuous passage between the discharge port and a cavity in which the pressure sensor is retained so that the sensor is continuously exposed to the discharge pressure regardless of the plunger position, and refrigerant discharge pressure in the lateral bore produces a bias force on the plunger that compensates the pneumatic suction pressure setpoint for a pressure drop between the evaporator and the suction port of the valve.

5 Claims, 2 Drawing Sheets

INTEGRATED CONTROL VALVE FOR A VARIABLE CAPACITY COMPRESSOR

FIELD OF THE INVENTION

This invention relates to a two-port capacity control valve for a variable capacity refrigerant compressor, and more particularly to a pneumatic regulating control valve that is electrically biased to adjust the pneumatic regulation setpoint.

BACKGROUND OF THE INVENTION

Variable capacity refrigerant compressors have been utilized in automotive air conditioning systems, with the compressor capacity being controlled by a control valve that is either pneumatically-operated or electrically-operated. In either case, the control valve typically varies the pressure in a crankcase of the compressor to control the compressor capacity. In a particularly economical arrangement, the compressor includes an internal bleed passage coupling the crankcase to suction (low-side) refrigerant pressure, and the control valve controls refrigerant flow though a control passage coupling the crankcase to discharge (high-side) refrigerant pressure by controlling the position of a plunger relative to the control passage. In pneumatically-operated control valves, the plunger is positioned by a bellows or diaphragm that is responsive to suction pressure, whereas in electrically-operated control valves, the plunger is positioned by the armature of a solenoid that is energized by a system controller. In general, pneumatically-operated control valves offer superior stability, while electrically-operated control valves offer superior flexibility. Accordingly, it has been proposed to integrate both pneumatic and electric control elements into a single control valve to obtain inherently stable and flexible suction pressure control. In such integrated control valves, the pneumatic control element establishes a predefined regulation setpoint for the suction pressure, and the electric control element is variably energized to bias the pneumatic element, effectively adjusting the regulation setpoint. See, for example, the U.S. Pat. Nos. 6,439,858 and 6,126,405, which are incorporated herein by reference.

SUMMARY OF THE PRESENT INVENTION

The present invention is directed to an improved integrated capacity control valve for a variable capacity refrigerant compressor, wherein the valve includes an integral pressure sensor that is continuously coupled to a discharge chamber of the valve for measuring the compressor discharge pressure. A plunger of the control valve is disposed within a passage coupling the compressor crankcase to the discharge chamber, and is positioned by pneumatic and electric control elements to regulate the suction pressure of the compressor. The plunger has intersecting axial and lateral bores that define a continuous passage between the discharge chamber and a cavity in which the pressure sensor is retained so that the sensor is continuously exposed to the discharge pressure regardless of the plunger position, and discharge pressure in the lateral bore produces a bias force on the plunger that compensates the pneumatic suction pressure setpoint for a pressure drop between the evaporator and the suction port of the compressor. The solenoid armature is pressure balanced and includes a movable coil that interacts with a stationary pole piece including one or more permanent magnets.

DESCRIPTION OF THE PREFERRED EMBODIMENT

Figure 1:
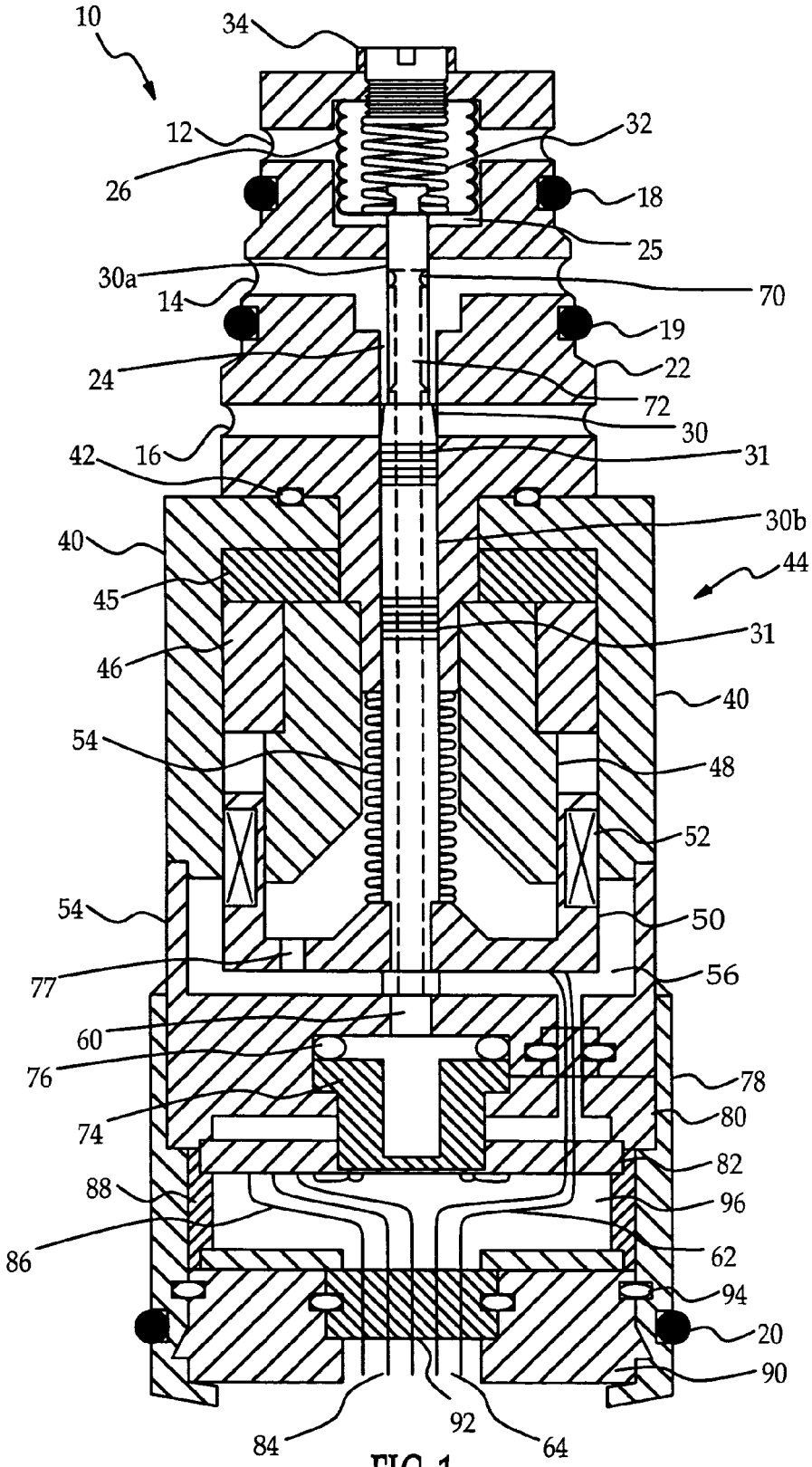
FIG. 1 is a cross-sectional view of an integrated capacity control valve according to this invention.

Referring to the drawing, the reference numeral 10 generally designates a compressor capacity control valve according to the present invention. The control valve 10 is designed to be mounted in the rear head of variable capacity refrigerant compressor such that the ports 12, 14 and 16 are respectively placed in communication with chambers containing the compressor suction, discharge and crankcase pressures, with the O-rings 18 and 19 positioned to prevent leakage from the discharge port 14 to the suction or crankcase ports 12, 16. A third O-ring 20 prevents leakage between the crankcase port 16 and atmosphere. The illustrated arrangement of valve ports is particularly advantageous since it matches the rear head refrigerant chamber configuration most commonly utilized in variable capacity compressors, facilitating fluid coupling between the control valve ports and the respective refrigerant chambers.

The purpose of the control valve 10 is to control the pressure in the crankcase chamber as a means of controlling the compressor capacity. In the illustrated embodiment, increasing the crankcase pressure causes the compressor pumping capacity to decrease, and decreasing the crankcase pressure causes the compressor pumping capacity to increase. The compressor includes an internal bleed valve between its crankcase and suction chambers to establish a full capacity compressor when the discharge chamber is isolated from the crankcase chamber, and the control valve 10 variably couples the discharge and crankcase chambers to raise the crankcase pressure to reduce the compressor capacity.

The suction, discharge and crankcase ports 12, 14 and 16 extend laterally in order through a pressure port 22 that includes an internal axial bore 24 coupling the ports 12, 14, 16. The inboard end of the bore 24 terminates in a suction chamber 25 that houses a pneumatic bellows 26, and a plunger 30 disposed within the bore 24 is press-fit into the outboard end of bellows 26 as shown. The bellows 26 includes an internal spring 32 axially aligned with the bore 24, and the inboard end of bellows 26 is seated against a setpoint adjustment screw 34 threaded into the inboard end of pressure port 22. As explained below, the screw 34 can be manually rotated to change the bellows spring force applied to plunger 30 for purposes of adjusting a pneumatic setpoint pressure of the control valve 10.

The plunger 30 includes an inboard portion 30*a* having a relatively small diameter and an outboard portion 30*b* having a diameter that is larger than the inboard portion 30*a*. The inboard portion 30*a* fits closely within the portion of bore 24 that couples the suction and discharge ports 12 and 14, but loosely within the portion of bore 24 that couples the discharge and crankcase ports 14 and 16, allowing a flow of discharge refrigerant between bore 24 and the inboard portion 30*a* of plunger 30. The outboard portion 30*b* of the plunger 30 is sized to fit closely within the portion of bore 24 that couples the discharge and crankcase ports 14 and 16, so that the plunger 30 can be axially positioned to control refrigerant flow from the discharge port 14 to the crankcase port 16. In general, inboard movement of the plunger 30 decreases the refrigerant flow to decrease the crankcase pressure, thereby increasing the compressor capacity, while outboard movement of the plunger 30 increases the refrigerant flow to increase the crankcase pressure, thereby decreasing the compressor capacity. The outboard portion 30*b* of plunger 30 is provided with balance grooves 31 that tend to fill with refrigerant during operation of the compressor 10. Lubricating oil is ordinarily suspended in the refrigerant, and the oil captured in the grooves 31 tends to laterally balance plunger 30 within the bore 24, minimizing the force required to axially displace plunger 30.

Bellows spring 32 produces an outboard force or bias on plunger 30 that is countered by an opposing pneumatic force proportional to the amount by which the suction pressure in chamber 25 exceeds a sub-atmospheric air pressure internal to the bellows 26. When the suction pressure achieves a calibrated setpoint, the spring force and pneumatic forces balance and the control valve 10 is in equilibrium. If system conditions cause the suction pressure to deviate from the setpoint, the bellows 26 expands or contracts, producing a corresponding axial movement of the plunger 30 within the bore 24 to counteract the suction pressure deviation and bring the control valve 10 back into equilibrium. For example, when the suction pressure increases due to increased air conditioning load, the bellows 26 contracts to produce inboard movement of the plunger 30. This reduces the discharge-to-crankcase refrigerant flow (and hence, the crankcase pressure), which produces increased compressor capacity. The increased compressor capacity eventually lowers the suction pressure, allowing bellows 26 to expand somewhat so that the compressor capacity is decreased to a level that maintains the suction pressure at the calibrated setpoint. Rotating the screw 34 to adjust its axial position within the pressure port 22 changes the bias force of bellows spring 32, and therefore the suction pressure setpoint. For example, adjusting the screw 34 to decrease its axial penetration into the pressure port 22 decreases the outboard spring force on plunger 30, which requires a corresponding reduction in the suction pressure if the pneumatic and spring forces are to be maintained in equilibrium; in other words, the suction pressure setpoint is correspondingly decreased. The opposite effect is achieved, of course, by rotating the screw 34 to increase its axial penetration into the pressure port 22.

Figure 2:
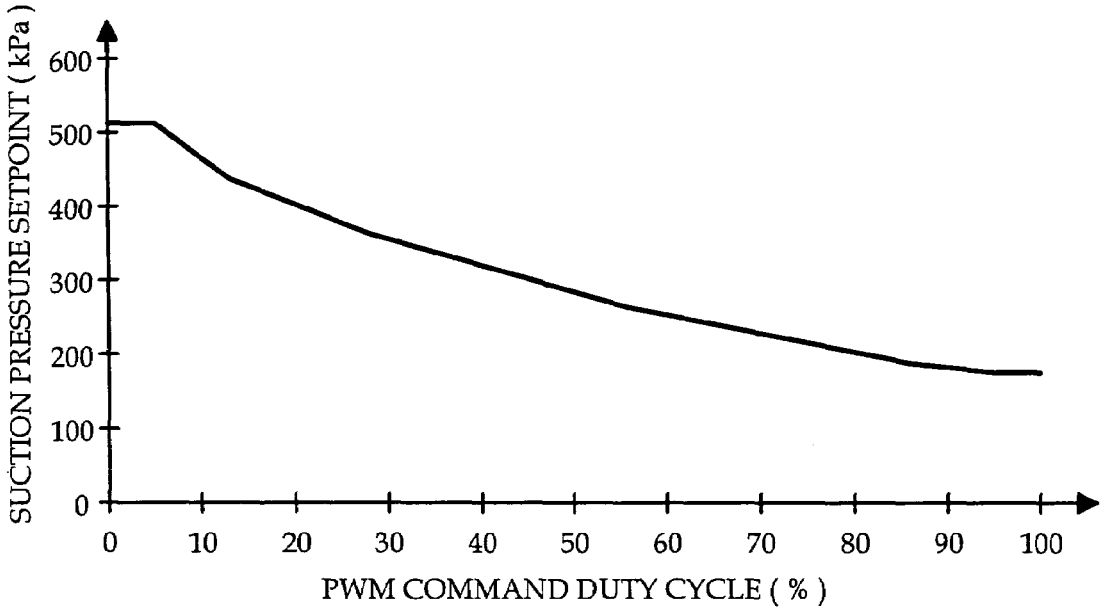
FIG. 2 graphically depicts variation in a suction pressure setpoint of the control valve of FIG. 1 as a function of electrical activation of the control valve.

The outboard end of pressure port 22 is received within a cylindrical housing member 40, compressing an O-ring seal 42 therebetween. The housing member 40 is part of a solenoid assembly 44 that when electrically activated biases plunger 30 in the inboard direction, effectively counteracting the force of bellows spring 26. This reduces the suction pressure setpoint just as though the screw 34 were adjusted to decrease its axial penetration into the pressure port 22 as described above. The solenoid force is proportional to the level of electrical activation so that the suction pressure setpoint can be controlled as graphically depicted in FIG. 2, where the solenoid activation level is depicted as a pulse-width-modulation (PWM) duty cycle.

The solenoid assembly 44 additionally includes a set of permanent magnets 45 and 46 disposed between the housing element 40 and an inner pole piece 48, and a cup-shaped spool 50 carrying a movable coil 52. The spool 50 is secured to the outboard end of plunger 30, and a housing element 54 is secured to the housing element 40, defining an internal cavity 56 in which the spool 50 can move axially with the plunger 30. A spring 58 disposed about plunger 30 between the spool 50 and the outboard end of pressure port 22 biases spool 50 and plunger 30 to the retracted position shown in FIG. 1, effectively aiding the spring force of bellows spring 26. In the illustrated limit position, the inboard end of plunger 30 rests against the housing element 54 about an aperture 60 axially aligned with the bore 24. The flexible conductors 62 couple the movable coil 52 to the terminals 64, and electrically energizing coil 52 via terminals 64 produces a magnetic field that attracts the spool 50 toward the permanent magnet 46, biasing the spool 50 and plunger 30 inboard against the force of springs 58 and 32.

Internal measurement of the discharge pressure is achieved by providing intersecting lateral and axial bores 70 and 72 within the plunger 30 and securing a pressure sensor 74 to the inboard face of housing element 54 about the opening 60. The pressure sensor 74, which may be a top-hat stainless steel diaphragm-type sensor, compresses an O-ring 76 against an outboard surface of the housing element 54, and is held in place by the base housing element 78 and the housing insert 80. Discharge refrigerant is coupled through the plunger bores 70, 72 into the aperture 60 of housing element 54 and the inner periphery of the pressure sensor 74. The discharge refrigerant also enters the cavity 56 (primarily when plunger 30 is displaced inboard from the limit position depicted in FIG. 1), and one or more openings 77 formed in the spool 50 ensure pressure equalization across the base of spool 50 during its movement.

The discharge refrigerant pressure acting on the inner periphery of pressure sensor 74 produces flexure of its diaphragm, and the mechanical strain associated with the flexure is detected by a piezo-resistor circuit (not depicted) formed on the exterior surface of the diaphragm. The piezo-resistor circuits are wire-bonded to bond pads formed on a circuit board 82 (which may also support signal conditioning circuitry), and the circuit board circuitry is coupled to the connector terminals 84 via the wires 86. The circuit board 82 has a central opening for receiving the outboard end of pressure sensor 74, and is held in place by the housing element 88 and the connector 90. The connector 90 is secured to the outboard end of base housing piece 78 as shown, and supports the terminals 64 and 84 in an insulative insert 92. An O-ring 94 compressed between the connector 90 and the housing piece 78 seals the enclosed area 96 from environmental pressures so that the pressure measured by sensor 74 can be calibrated to indicate the absolute discharge pressure, as opposed to a gauge pressure that varies with ambient or barometric pressure.

The continual presence of discharge pressure in the lateral bore 70 of plunger 30 creates a small but significant force that biases the plunger 30 inward. This discharge pressure bias effectively aids the suction pressure in suction chamber 25, thereby compensating for diminution of the refrigerant pressure between the evaporator of the air conditioning system and the suction chamber of the compressor. The compensation is fairly accurate since the evaporator-to-compressor refrigerant pressure diminution or drop is substantially proportional to the discharge pressure. Accordingly, the suction pressure setpoint of the control valve 10 actually occurs at the evaporator instead of the compressor suction port 12. Although this sort of compensation is known per se in pneumatically-operated valves, it is provided at no additional cost in the control valve 10 since the lateral bore 70 is already provided for purposes of discharge pressure measurement.

In operation, the energization of movable coil 52 is pulse-width-modulated to dither the plunger 30 within the bore 24 to control the refrigerant pressure in the compressor crankcase. The configuration of solenoid assembly 44 with the movable coil 50 and stationary permanent magnets 45 and 46 significantly reduces the electrical power required to activate the valve 10, compared to a conventional fixed-coil design. The power requirement is additionally reduced by the balance grooves 31, which minimize the frictional forces acting on the plunger 30. In one implementation of this invention, for example, the maximum required coil current was only 300 mA, compared to a 1000 mA maximum current requirement in a conventional fixed-coil design, and the average current requirement under all operating conditions was reduced by at least 67%, compared to a conventional fixed-coil design. This reduction in the power requirement is particularly important in automotive applications because the generated electrical power is limited, particularly at low engine speeds. The system cost is also significantly reduced compared with a conventional approach because the discharge pressure is continuously and accurately measured by the internal sensor 74. And finally, the discharge pressure in the lateral bore 70 of plunger 30 compensates for the evaporator-to-compressor refrigerant pressure drop so that the control valve 10 can effectively regulate the refrigerant pressure upstream of the compressor suction port.

While the present invention has been described in reference to the illustrated control valve 10, it will be recognized that various modifications in addition to those mentioned above will occur to those skilled in the art. For example, a diaphragm can be substituted for the bellows 26, if desired. Also, the control valve may be modified to include integral suction pressure measurement through the inclusion of an additional pressure sensor and auxiliary suction port. Further, the pressure sensor 74 may be replaced with a temperature sensor since the relationship between pressure and temperature of refrigerant in a closed volume system is known, and so on. Accordingly, capacity control valves incorporating such modifications may fall within the intended scope of this invention, which is defined by the appended claims.

The invention claimed is:

1. A refrigerant compressor capacity control valve comprising suction, discharge and crankcase ports, and a plunger positionable within a central axial bore of said control valve for controlling refrigerant flow from said discharge port to said crankcase port to achieve compressor capacity control, wherein:

said central axial bore terminates in a suction chamber coupled to said suction port, said suction chamber housing a pneumatically-operated control element secured to a first end of said plunger for producing a first axial bias on said plunger in relation to refrigerant pressure in said suction chamber;

an electrically-operated control element secured to a second end of said plunger for producing a second axial bias on said plunger in relation to an electrical activation level thereof;

a lateral plunger bore open to refrigerant pressure at said discharge port, and an axial plunger bore extending from said lateral plunger bore through the second end of said plunger;

a housing element defining a stop for the second end of said plunger and having an aperture axially aligned with said axial plunger bore so that refrigerant discharge pressure is continuously coupled to said aperture through said lateral plunger bore and said axial plunger bore; and a sensor responsive to the refrigerant discharge pressure in said aperture.

2. The capacity control valve of claim 1, wherein said pneumatic control element is a bellows having a first end secured to the first end of said plunger and an internal spring that produces a spring bias on said plunger, the capacity control valve further comprising:

an adjustment mechanism disposed in an end of said control valve and engaging a second end of said bellows, said adjustment mechanism being axially movable to adjust the spring bias of said internal spring.

3. The capacity control valve of claim 1, wherein discharge refrigerant pressure in said lateral plunger bore exerts a third axial bias on said plunger that aids said first axial bias produced by said pneumatically-operated control element.

4. The capacity control valve of claim 1, wherein said electrically-operated control element includes a permanent magnet pole piece disposed about said plunger, and a moving coil armature affixed to said plunger such that electrical activation of said moving coil armature produces said second axial bias by virtue of an attractive force between said moving coil armature and said permanent magnet pole piece.

5. The capacity control valve of claim 1, wherein said suction, discharge and crankcase ports are arranged in order, with said suction port being disposed inboard of said discharge and crankcase ports.

* * * * *